US005630674A

United States Patent [19]

Inaba

[11] Patent Number: 5,630,674

[45] Date of Patent: May 20, 1997

[54] ROAD SURFACE

[76] Inventor: Takeo Inaba, 1-7-25, Mineoka-tyo, Hodogaya-ku, Yokohama-shi, Kanagawa-ken, Japan

[21] Appl. No.: 541,895

[22] Filed: Oct. 10, 1995

[30] Foreign Application Priority Data

Oct. 24, 1994 [JP] Japan ..... 6-284399

[51] Int. Cl.[6] ..... E01C 5/22; E01C 9/02

[52] U.S. Cl. ..... 404/2; 404/6; 404/15; 404/16; 404/32; 404/71

[58] Field of Search ..... 404/2, 9, 14, 15, 404/16, 22, 27, 28, 29, 32, 33, 39, 43, 44, 47, 71, 36, 42, 17

[56] References Cited

U.S. PATENT DOCUMENTS

| | | | |
|---|---|---|---|
| 1,577,610 | 3/1926 | Clark et al. | 404/33 |
| 2,323,848 | 7/1943 | Schaeffer | 404/42 |
| 2,574,090 | 11/1951 | Dofsen | 404/15 |
| 3,038,392 | 6/1962 | Jezl | 404/33 |
| 3,894,686 | 7/1975 | Weinberg et al. | 404/32 X |
| 4,693,300 | 9/1987 | Adachi | 404/71 X |
| 4,813,811 | 3/1989 | Adams | 404/9 X |
| 4,973,505 | 11/1990 | Bielous | 404/32 X |
| 5,087,148 | 2/1992 | Wyckoff | 404/14 X |
| 5,281,459 | 1/1994 | Van Eijck | 404/33 X |
| 5,391,226 | 2/1995 | Frankowski | 404/32 X |

FOREIGN PATENT DOCUMENTS

| | | | |
|---|---|---|---|
| 766503 | 10/1971 | Belgium | 404/32 |
| 2823375 | 12/1979 | Germany | 404/32 |
| 56-30404 | 7/1981 | Japan . | |
| 5179604 | 7/1993 | Japan | 404/32 |
| 201861 | 8/1923 | United Kingdom | 404/33 |
| 211321 | 2/1924 | United Kingdom | 404/32 |
| 414767 | 8/1934 | United Kingdom | 404/32 |
| 436643 | 10/1935 | United Kingdom | 404/32 |

*Primary Examiner*—James Lisehora

*Attorney, Agent, or Firm*—Armstrong, Westerman, Hattori, McLeland & Naughton

[57] ABSTRACT

A road surface formed by laying a multiplicity of molded elastic plates 2 each containing a rubber material 6 mixed with an aggregate 7 having anti-wear properties. These elastic plates 2 are laid on a roadbed 3, and are fixed by fixing means 20. Strong adhesive force between this rubber material and the aggregate greatly suppresses peeling of the aggregate 7 from the rubber 6 and prevent formation of pit holes on the surface of the road. The highly elastic nature of the elastic plates prevents plastic deformation and cracks of the road due to vehicle load, suffer little change with temperature variation, providing long-term durability. Accordingly, the frequency of repairs or modifications carried out to improve durability is drastically reduced, and the number of defects is reduced so that the safety of vehicles using the road is increased. A multiplicity of grooves 26 provided in the vehicle travel direction on the surface of the elastic plate 2 guide the wheels of vehicles so as to confer directionality and increase road safety. A light reflecting layer 27 formed on the inner walls of the grooves 26 makes the road surface stand out at night or in dark areas of terrain so that it can be better seen by drivers, thereby contributing to greater road safety.

10 Claims, 10 Drawing Sheets

ROAD SURFACE

BACKGROUND OF THE INVENTION

This invention relates to a road surface laid on expressways or ordinary roads, and more particulary to a road surface wherein the frequency of repairs or modifications carried out to improve durability is drastically reduced, and the number of defects is reduced so that the safety of vehicles using the road is increased.

BACKGROUND OF THE INVENTION

Road surfaces for expressways and roads are generally formed by laying an asphalt mixture comprising an aggregate of a suitable material such as for example crushed stone, gravel, sand or filler and asphalt, on a roadbed. This asphalt mixture is prepared by mixing the aggregate with asphalt in a plant or factory, transporting it to where it has to be laid, spreading it on the roadbed, and compacting it with a roller.

This road surface is designed to last about 10 years, but its lifetime may be shorter depending on the volume of traffic or other conditions.

For example, on roads with heavy traffic, the passage of vehicles may cause wear of the surface, and rutting may occur, i.e. the asphalt mixture may flow to the left or right, in parts of the road where vehicles frequently pass. These phenomena are particularly marked in summer, when the physical properties of the asphalt mixture are liable to vary and the mixture tends to flow more easily.

Again, when the road is subjected to repeated vehicle loads or melting of ice in very cold climates, the aggregate in the wearing course may separate from the asphalt leading to the formation of small holes. When such small holes form, the surrounding aggregate and asphalt also tend to separate so that the holes gradually develop into large hollows, or "potholes". These potholes not only interfere with the passage of vehicles, but may also cause unpredictable accidents.

For this reason road surfaces which have suffered damage due to fluid decomposition or potholes as hereintofore described are destroyed, a new road surface is laid, and another layer of asphalt mixture is laid on top so as to repair the road.

However, when traffic is heavy, repair work has to be carried out frequently, obstructing the passage of vehicles and causing traffic jams. On expressways where the traffic volume is very high, traffic jams may impair vital transport functions and have serious social consequences, moreover the repair work itself is sometimes dangerous.

In the past rubber materials have been used to prolong life time of a road surface, as disclosed in Japanese Patent Early Publication 3-200851, which is however, used in a different context. That is, it was intended to improve durability of the road surface against spike tires, and was not intended to improve durability of high ways where a very heavy traffic load is encountered.

Also in the Japanese Patent Early Publications 4-52301, 4-52302, 6-299503, 7-18614 and Japanese Patent Publication 6-62787, use of blocks containing rubber as a major component thereof have been disclosed. However, all of these are concerned with the pavement of side-walks. Obviously, requirements for these pavements are totally different from those for road surfaces for heavy-traffic roads. Therefore, new types of durable road surfaces are desirable for such heavy-traffic roads.

It is therefore an object of the invention to provide a road surface wherein the frequency of repairs or modifications carried out to improve durability is drastically reduced, and the number of defects is reduced so that the safety of vehicles using the road is increased.

SUMMARY OF THE INVENTION

In order to achieve the above objectives, this invention provides a road surface formed by laying a multiplicity of molded elastic plates each containing aggregates having wear resistance mixed with a rubber material, on a roadbed.

It is desirable that these aggregates interlock strongly with one another, such as is the case for example when the surfaces of the aggregates have many irregularities. Interlocking properties also improve when flat or needle-shaped particles are excluded. The roadbed may comprise compacted gravel or sand wherein the particle diameter has been adjusted or concrete slabs.

The elastic plate according to this invention may comprise only one layer provided that it is formed from an aggregate mixed with a rubber material having anti-wear properties. However, more preferably, it comprises a wearing course forming the road surface and a base course laid underneath this wearing course, the aggregate mixed into the base course being different from the aggregate mixed into the wearing course. In this case, it is desirable that the wearing course and base course are joined such that they can be detached from one another. The means for joining wearing course to the base course may for example be a snap locking system comprising projections with protruding tips on either the wearing course or base course that snap into narrow apertures on the other course, an adhesive system that uses an adhesive having a limited adhesive force, or a surface fastening system that uses a surface fastener.

Any means may be used to lay and fix the elastic plate on the roadbed, for example a fixing means comprising an anchor member and a press member that fixes the elastic plate to the roadbed.

The surface of the elastic plate comprising the road surface may be flat, or a multiplicity of grooves may be formed on the surface in the vehicle travel direction. When grooves are provided on the surface of the elastic plate, it is desirable to provide a light reflecting or light emitting layer on the inner walls or base surface of the grooves. If the surface of the elastic plate is flat, it is desirable to provide a multiplicity of voids in the vehicle travel direction underneath the surface of the elastic plate comprising the road surface.

The elastic plate may be provided with a heating body embedded therein for use in regions where it has cold climates.

The elastic plate may be also provided with a multiplicity of througholes in a vertical direction for allowing rainwater to pass. In this case, the elastic plate preferably has a multiplicity of drain grooves provided in an effectively perpendicular direction to the vehicle travel direction underneath the plate, these grooves being connected with the throughholes.

It is desirable that the elastic plate contains protrustons provided intermittently in the vehicle travel direction of the surface of the plate forming the road surface so as to give a jolt to wheels of vehicles traveling on the surface.

Elastic plates may be joined to each other by any means. However, it is desirable that joins of adjacent elastic plates are oriented at an oblique angle to the vehicle travel direction and are supported so as to permit relative displacement of the plates relative to one another along the join line.

The elastic plates may be laid over the entire width of the roadway, but they are preferably laid only over the vehicle lane of the roadway.

With the inventive structures of the road surface mentioned above, the invention provides the following functions.

Since the road surface according to this invention uses a rubber material as binder such as vulcanized rubber, thermoplastic rubber or neoprene rubber, the adhesive force between this rubber material and the aggregate is strong, so there is practically no peeling of the aggregate from the rubber. The rubber material is also highly elastic, and as its physical properties suffer little change with temperature variation, its properties are maintained over a long period of time. Therefore, no cracks or fluidity occur in the road surface.

Further, due to the use of an aggregate with anti-wear properties, wear of the road surface can be reduced even if vehicles repeatedly travel on it.

Since the elastic surface contains a wearing course that forms the road surface and a base course laid underneath the wearing course, and since the aggregate mixed into the base course is different from the aggregate mixed into the wearing course, the particle diameter of the aggregate in the base course can thus be made larger than that in the wearing course, and a low quality aggregate may also be used. This reduces material costs, and makes the molding operation more efficient. Further, in this case, if the wearing course is joined to the base course such that it can be detached from it, the wearing course alone can be removed which permits easy repair or replacement.

The fixing means that fixes the base course to the roadbed includes an anchor member and press member, hence the base course can be easily and firmly fixed to the roadbed, and the elastic plate can be securely laid on the roadbed.

The multiplicity of grooves provided in the vehicle travel direction on the surface of the elastic plate forming the road surface, function so as to guide vehicle wheels and confer directionality, thereby increasing road safety. Further, by providing a light reflecting or light emitting layer on the inner walls or base of the grooves, the road surface is made to stand out at night so that it can be seen by the drivers of the vehicles, thereby contributing to greater road safety.

By providing a multiplicity of voids In the vehicle travel direction underneath the surface of the elastic plate forming the road surface, the voids flatten under the load of the vehicle wheels so that depressions form on the road surface. This helps to guide the wheels and contributes to greater road safety.

By embedding a heating body in the elastic plate, accumulation of snow or ice on the road surface in cold climates is prevented, thereby contributing to greater road safety.

By providing a multiplicity of througholes in a vertical direction for passing rainwater, rainwater on the road surface can be rapidly drained off the road through these holes. This prevents slipping, skidding or splashing due to pools of water, and reduces vehicle noise.

By providing protrusions intermittently in the vehicle travel direction on the surface of the elastic plate forming the road surface, and setting the shape, dimensions and intervals between the protrusions so as to give a jolt to the vehicle wheels, the driver is alerted when the vehicle approaches the side of the road or tends to drift outside the vehicle lane, enabling the driver to take corrective action.

By orienting joins between adjacent elastic plates at an oblique angle relative to the vehicle travel direction, and supporting them so as to permit relative displacement of the plates relative to one another along the join line, buckling or gaps between adjacent plates are prevented when the plates expand or contract due to winter and summer temperature variations.

Finally, by laying elastic plates only in the vehicle wheel tracks in the roadway width, the durability of the road surface is improved only where necessary which reduces construction costs.

BRIEF DESCRIPTION OF THE DRAWINGS

FIG. 9(*b*) is a sectional view showing the structure of a second type of joint capable of joining the elastic plates.

FIG.9(*c*) is a sectional view showing the structure of a third type of joint capable of joining the elastic plates.

FIG. 9(*d*) is a sectional view showing the structure of a fourth type of joint capable of joining the elastic plates.

FIG. 13(*b*) is a schematic sectional view showing a third embodiment of the road surface according to the invention wherein the road surface is constructed on a concrete slab casted in the banking.

DESCRIPTION OF THE PREFERRED EMBODIMENTS

This invention will now be described in more detail with reference to the drawings appended herewith.

EMBODIMENT 1

Figure 1:
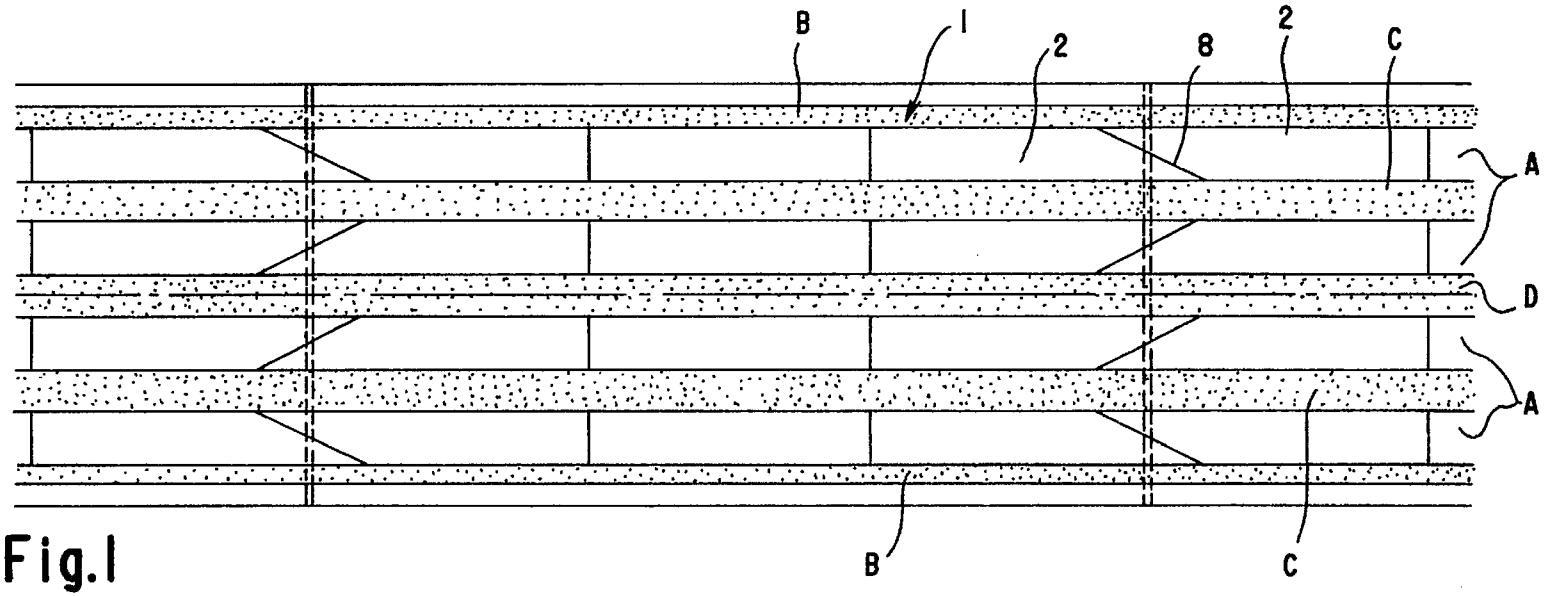
FIG. 1 is a schematic plan view showing a road surface laid according to the first embodiment of the invention.
Figure 2:
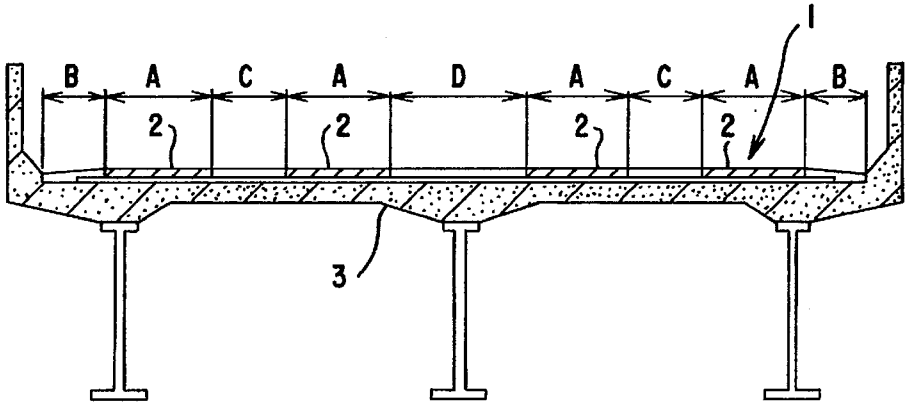
FIG. 2 is a schematic sectional view of FIG. 1.

FIG. 1 is a schematic plan view of a road surface according to a first embodiment of this invention. FIG. 2 is a schematic view in section of same.

A road surface 1 according to this invention comprises a multiplicity of elastic plates 2 laid on, for example, wheel tracks A on a concrete slab 3 (roadbed) supported by struts. Asphalt surface of the road surface, laid on shoulders (B) between wheel tracks (C) and between adjacent vehicle lanes (D) as shown in FIG. 1 and 2, may be convention one.

Figure 3:
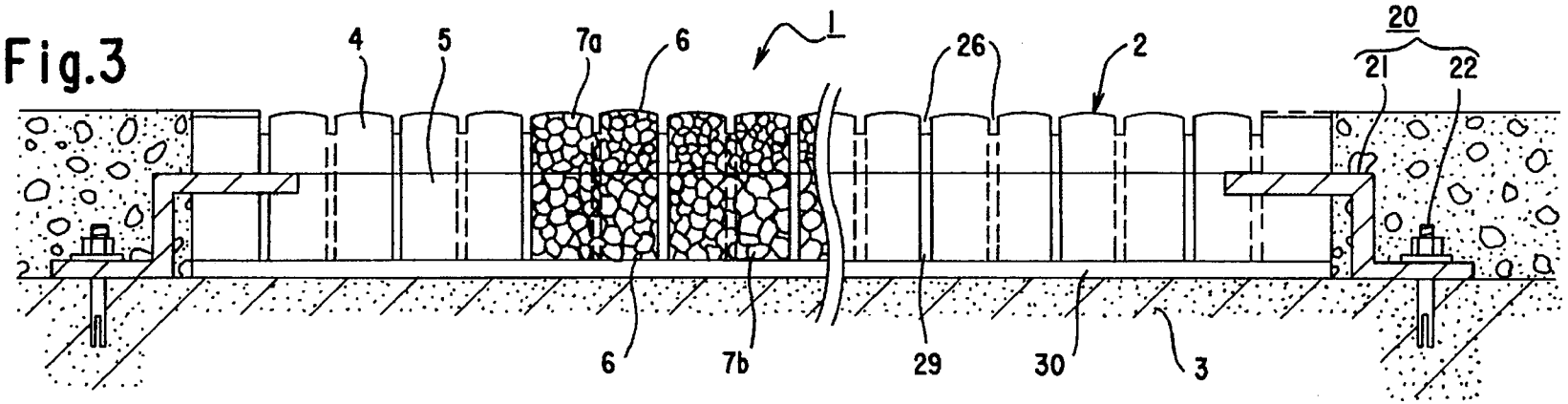
FIG. 3 is a sectional view showing the construction of a road surface according to the first embodiment of this invention.
Figure 4:
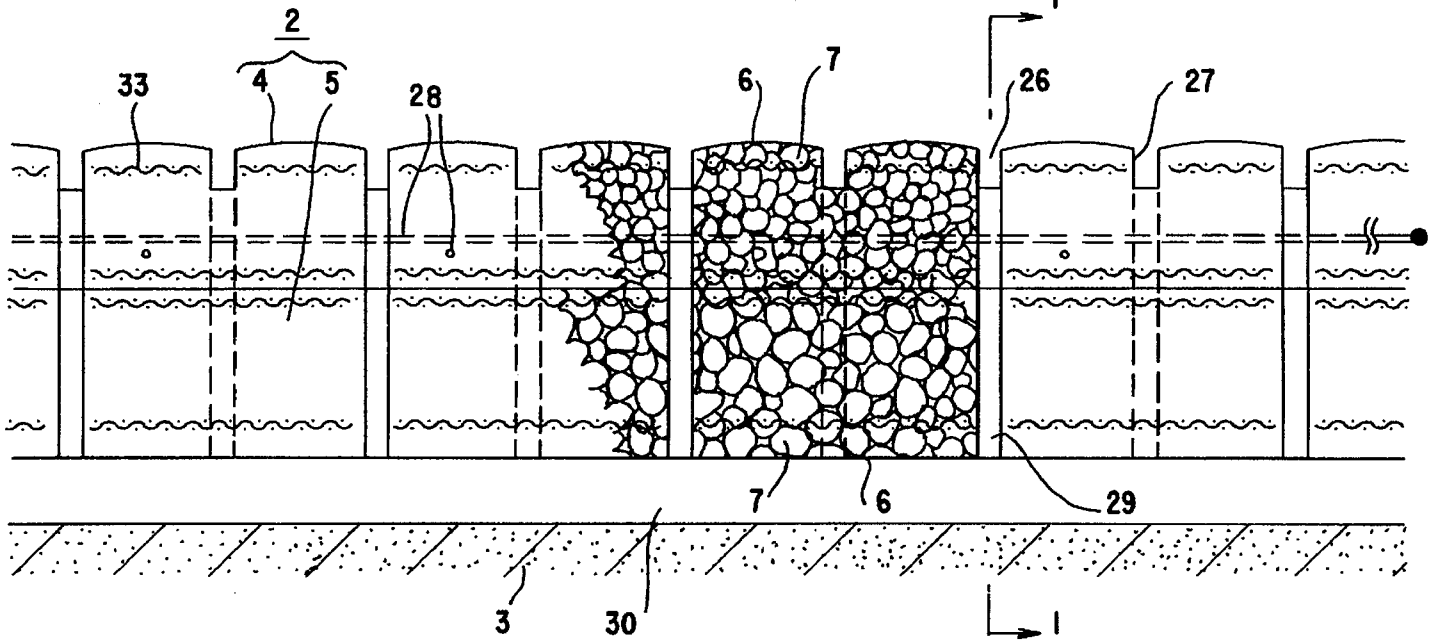
FIG. 4 is a sectional view perpendicular to a vehicle lane of an elastic plate used for the road surface shown in FIG. 3.
Figure 5:
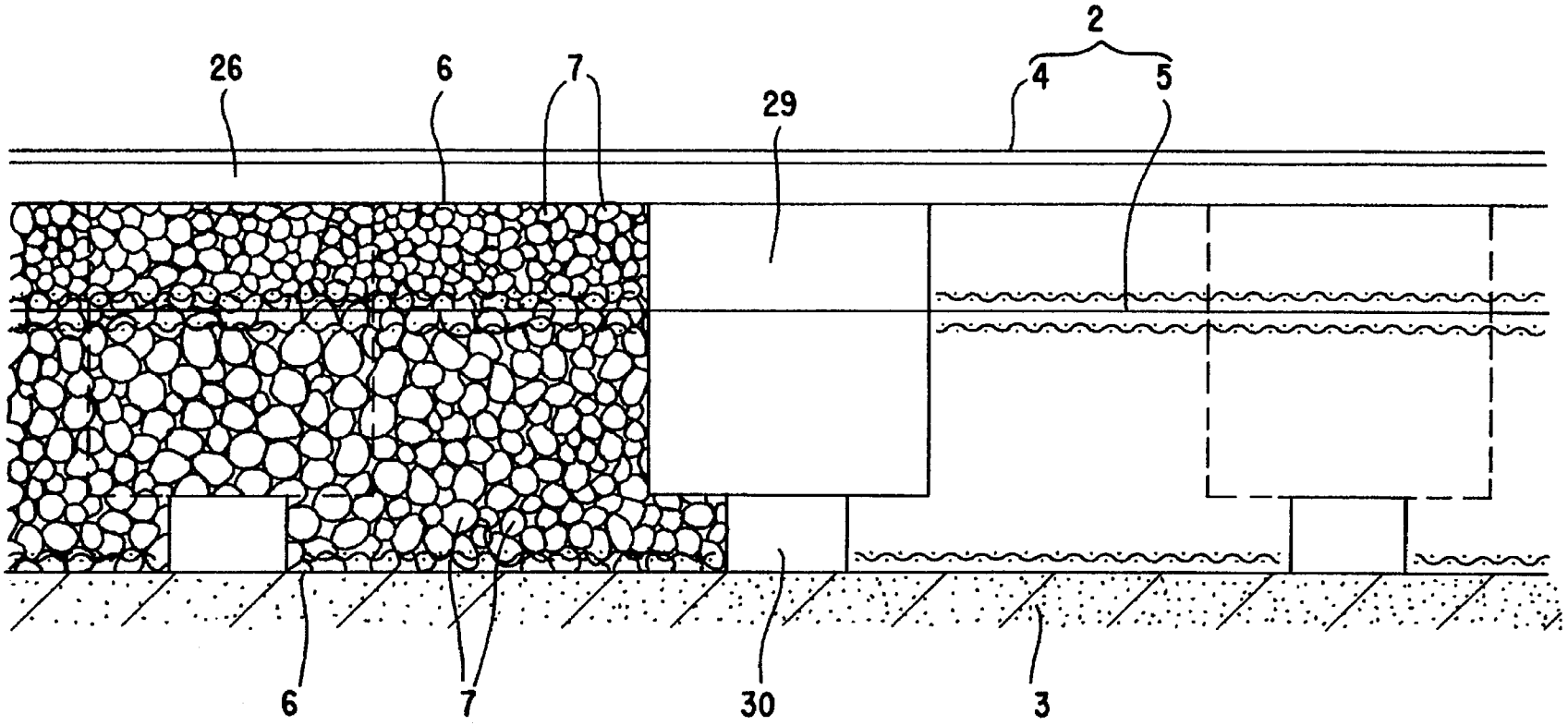
FIG. 5 is a sectional view in the direction of a vehicle lane of the elastic plate used for the road surface shown in FIG. 3.
Figure 6:
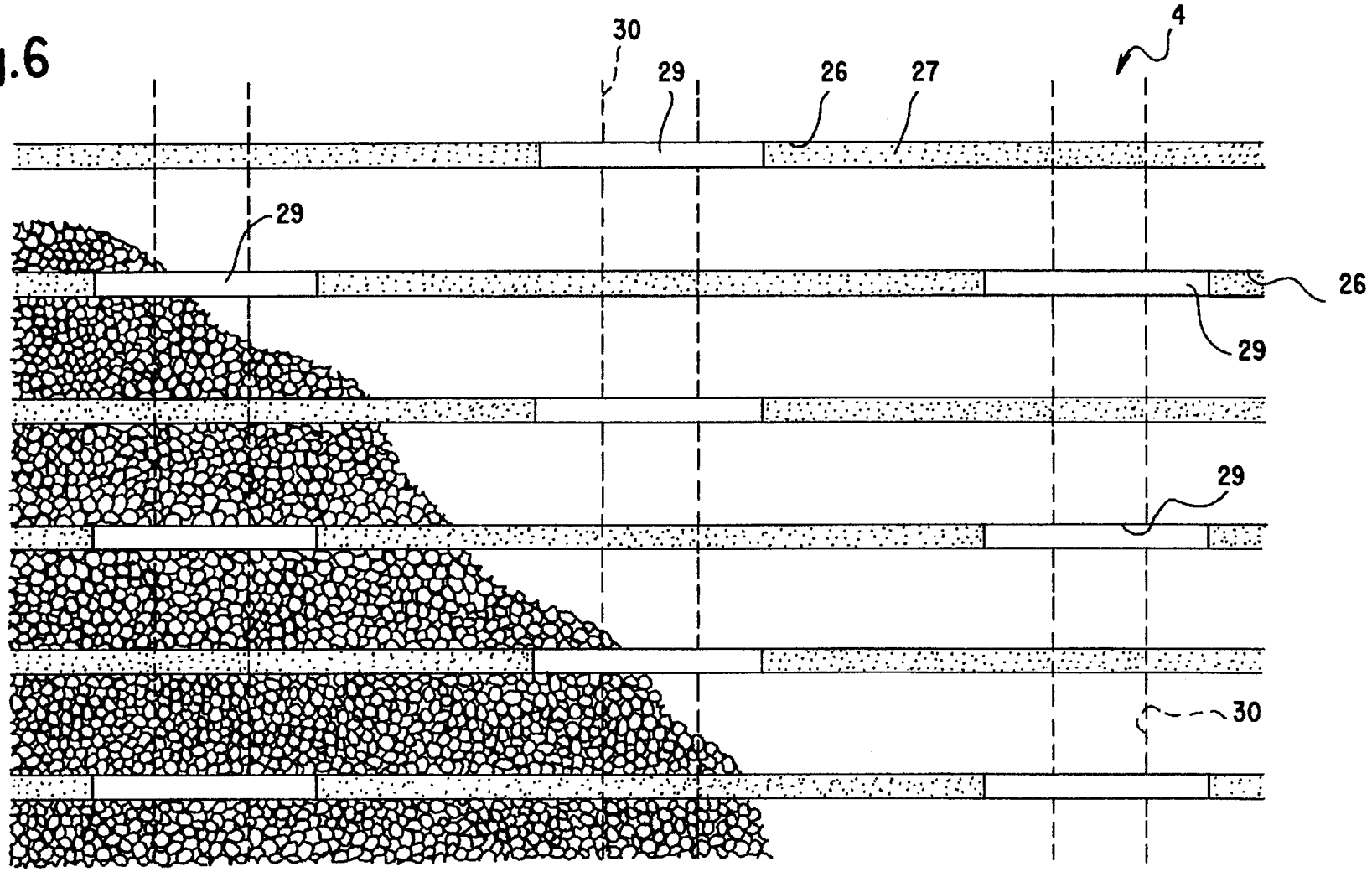
FIG. 6 is a plan view of an elastic plate used for the road surface shown in FIG. 3.
Figure 7:
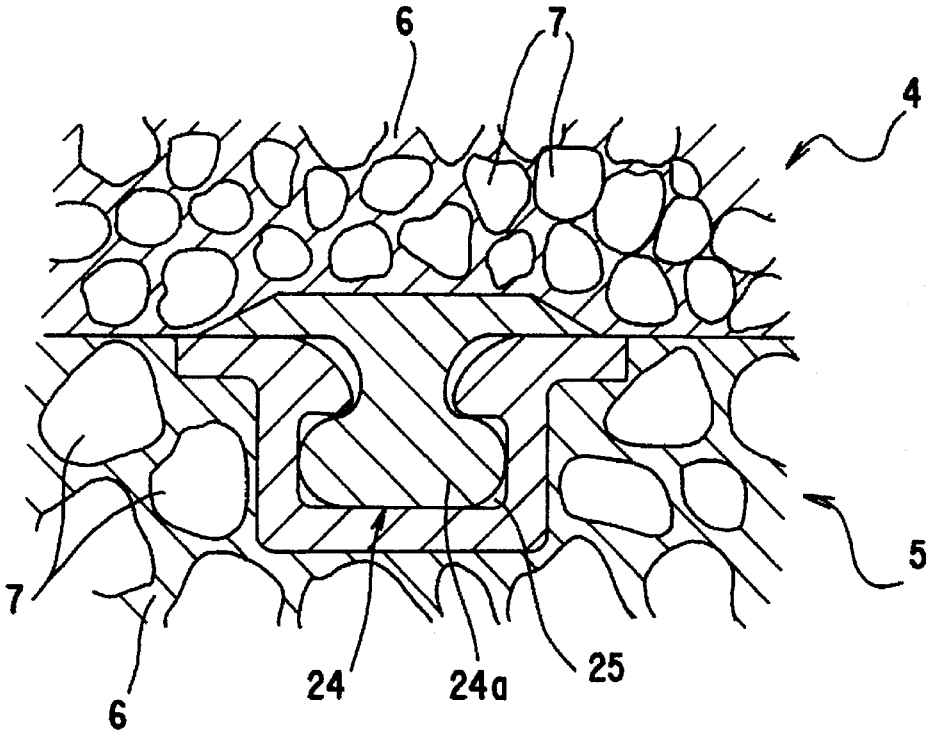
FIG. 7 is an enlarged sectional view of the join between a wearing course and a base course according to this invention.

FIG. 3 is a view in section in a perpendicular direction to a vehicle lane on the road surface. FIG. 4 is an enlargement of FIG. 3, and FIG. 5 is a view in section in the direction of the vehicle lane (section I—I in FIG. 4). FIG. 6 is a plan view of the road surface.

The elastic plate 2 comprises a wearing course 4 of thickness approximately 30 mm forming the road surface, and a base course 5 of thickness approximately 50 mm laid underneath the wearing course, as shown in FIG. 3. This wearing course 4 and base course 5 are respectively formed by mixing an aggregate 7 having antiwear properties with a rubber material 6. Rubber materials 6 that may be used for the elastic plate are for example vulcanized rubber, thermoplastic rubber or neoprene rubber. An aggregate 7*a* used for the wearing course 5 may for example be chosen from ceramic particles, converter slag, electric furnace oxidized slag, glass chips, orthoclase, quartz, topaz or corundum. The aggregate may include a mixture of particles having diameters in the range of for example 5–10 mm. Alternatively, particles having effectively the same diameter within the aforesaid range may be separated and used. An aggregate 7*b* of the base course 5 may for example be chosen from crushed stone, reclaimed crushed stone, lava rock, gravel or old tyre chips, the particle diameter being in the range of for example 5–15 mm.

It is desirable that there is a strong interlocking force between aggregates. Interlocking forces between aggregates distribute and transmit the load from the road surface to the roadbed when the load is applied to the the elastic plates.

By using aggregates with strong interlocking properties, increased deformation of the elastic plate is prevented, stress between rubber materials or between the rubber material 6 and aggregate 7 is reduced, and durability is improved.

Aggregates having excellent interlocking properties are for example aggregates having surface irregularities, or aggregates from which flat or needle-like particles have been removed. The particle shape may be adjusted so that interlocking forces increase when the ceramic particles, slag or glass chip are manufactured.

A reinforcing mesh 33 may be embedded in the vicinity of the surface and base of the wearing course 4 and base course 5 as shown in FIGS. 4 and 5 in order to reinforce the elastic plate 2. This reinforcing mesh 33 may be formed of for example carbon fiber, alamide fiber, pinion fiber, carbon steel wire, stainless steel wire, piano wire or PC steel wire. The mesh size is the same as or slightly less than the particle diameter of the aggregate 7.

The proportion of the rubber material 6 and aggregate 7 in the elastic plate 2 may be adjusted as desired depending on the material chosen, for example three parts of rubber to seven parts of aggregate may be used.

By mixing the rubber material 6 and aggregate 7 as hereintofore described, the aggregate 7 and rubber material 6 are blended such that they adhere to each other, and there is no risk that the aggregate 7 will peel away from the wearing course 4. Further, as the elastic plate 2 comprises the wearing course 4 and base course 5, a cheaper aggregate 7*b* may be chosen for the base course 5 than the aggregate 7*a* blended in the surface course 4, and by using an aggregate 7 having a large particle diameter, material costs may be reduced and the elastic plate 2 can be manufactured economically.

The wearing course 4 is superposed on the base course 5 such that it can be detached from it. This may be achieved by a snap lock system wherein engaging projections 24 with tips 24*a* are provided at suitable points on the underside of the wearing is course 4, narrow apertures 25 being provided on the upper surface of the base course 5 such that they detachably engage with the projections 24. The detachable linkage between the base course 5 and wearing course 4 is however not limited to this snap lock system, possible alternatives being the use of an adhesive at specific points or a surface fastening system comprising surface fasteners.

By making the linkage between the base course 4 and wearing course 5 detachable, the surface course 4 may be removed alone permitting Its easy repair or replacement.

A multiplicity of grooves 26 are provided in the vehicle travel direction on the surface of the wearing course 4 of the elastic plate 2 (FIGS. 3 to 6). These grooves 26, which are provided at an interval of approximately 30 mm and each have a width of 5 mm, guide the wheels of vehicles so as to confer directionality and increase road safety. A light reflecting layer or light emitting layer 27 is formed on the inner walls of the grooves 26. This layer 27, which for example is formed from powdered glass blended with paint, fluorescent paint, or the like, makes the road surface stand out at night or in dark areas of terrain so that it can be better seen by drivers, thereby contributing to greater road safety.

A heating body 28 such as a heating wire or the like is embedded in the vehicle travel direction and direction perpendicular to the vehicle travel direction in the wearing course 4 of the elastic plate 2 (FIG. 4). Lead wires running off from this heating body 28 are connected to a heating power supply (not shown), and the temperature of the road surface is controlled by a temperature controller (not shown). When fallen snow accumulates on the wearing course 4 or when ice may form on the road surface, the heating power supply switches ON and the heating body 28 emits heat so that ice does not form, thereby improving road safety.

A multiplicity of througholes 29 are formed in a vertical direction in the elastic plate 2 so as to allow rainwater to pass. These throughholes 29 are provided at suitable intervals in the base of the grooves 26, and are formed in a rectangular shape of width approximately 5 mm and length 50 mm (FIGS. 3–6). A multiplicity of drain grooves 30 connected with the throughholes 29 are also provided underneath the elastic plate 2 effectively perpendicular to the vehicle travel direction (FIGS. 3–6).

By providing the throughholes 29 and drain grooves 30, rainwater that has accumulated on the road surface flows first into the grooves 26, and then into the grooves 30 via the throughholes 29. As the water is drained off the road surface, there is no slipping, skidding or splashing due to pools of water on the road, and road safety is improved. In addition, the vehicles on the road make less noise.

Figure 8:
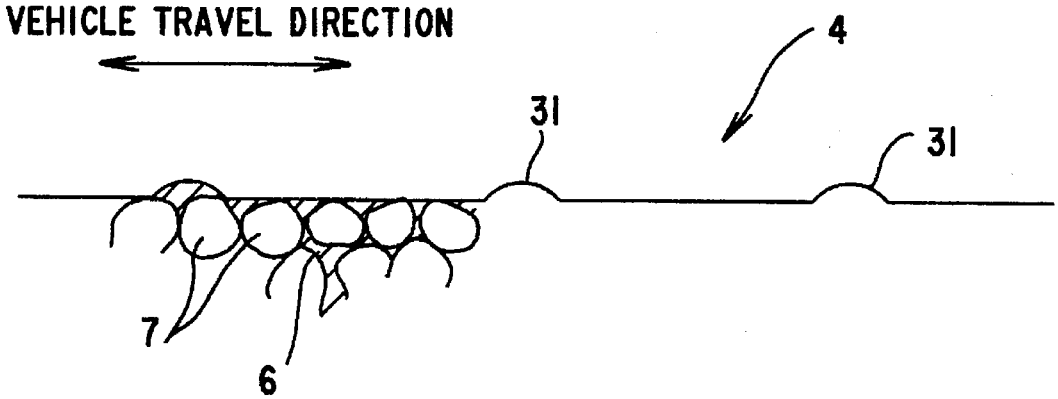
FIG. 8 is a plan view showing protrusions provided on the surface of a road surface.
Figure 9A:
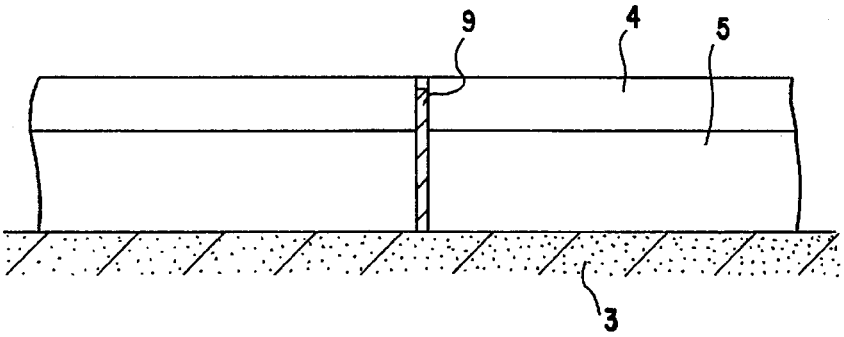
FIG. 9(*a*) is a sectional view showing the structure of a vertical joint between elastic plates.
Figure 9B:
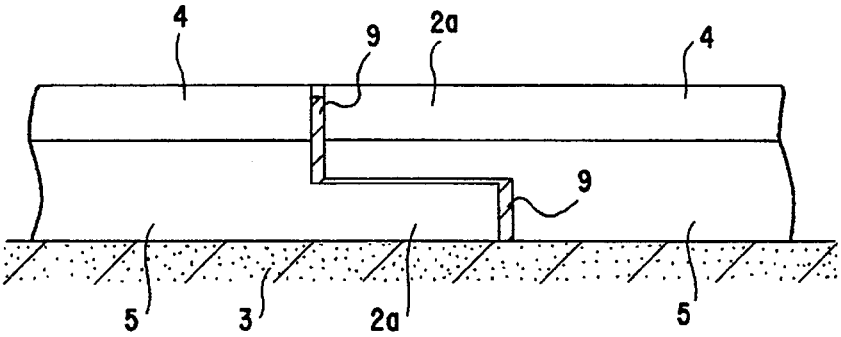
Figure 9C:
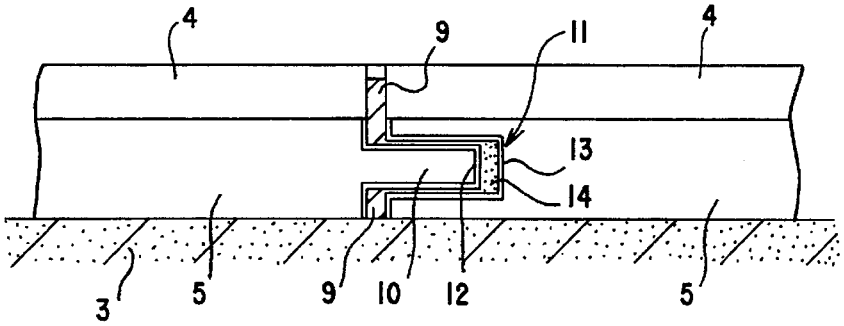
Figure 9D:
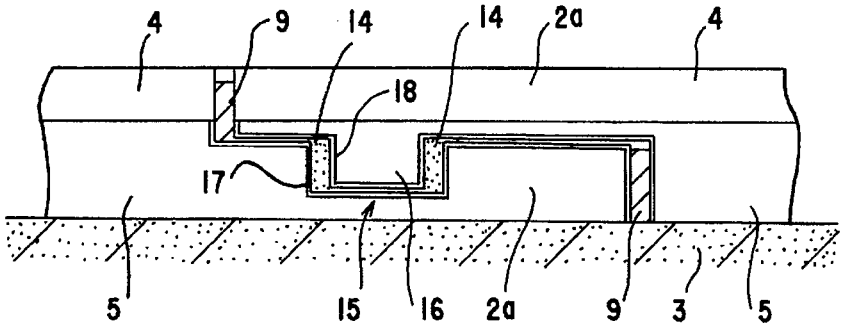

Protrusions 31 are also provided intermittently on the surface of the wearing course 4 forming the road surface in the vehicle travel direction as shown in FIG. 8. These projections 31 give a jolt to the wheels of a vehicle when the vehicle approaches the curb at the side of the road or drifts off the wheel tracks, alerting the driver and giving a greater measure of safety.

The elastic plate 2 is fixed to the concrete base (roadbed) by a fixing means 20 shown in FIG. 3. This fixing means 20 includes an anchor bolt 22 implanted in the concrete base 3 and a press member 21 of which one end is pressed into the upper surface of the base course 5, the region near the other end being fixed to the roadbed 3 by the bolt 22. The means 20 are provided at a certain distance from each of the two ends of the elastic plate 2 so as to fix the elastic plate.

The joins of adjacent elastic plates 2 have a join line 8 at an oblique angle to the vehicle travel direction as shown in FIG. 1, thereby permitting displacement of the adjacent plates 2 relative to one another along the join line. This prevents buckling or gaps at the join line when the plates 2 expand or contract due to temperature variations between winter and summer, and thereby confers a greater degree of road safety.

The adjacent plates 2 may for example be joined by a highly elastic material such as silicon rubber, foam rubber or an asphalt sealant, or via a filler 9 such as an adhesive as shown by the vertical section of FIG. 9(*a*), or they may be joined as shown in FIGS. 9(*b*)–(*d*). Notches may be cut out of the upper and lower parts of the plates 2 at the join, and the parts 2*a* to be joined brought into contact via the filler 9 (FIG. 9(*b*)). Alternatively, a projection 10 may be provided on the joining surface of one of the plates 2, and a recess 11 engaging with the projection 10 provided on the joining surface of the other plate 2. Metal caps 12 and 13 are coated respectively on the projection 10 and recess 11, the central contact area is filled with an antirust, lubricating oil 14, and the upper and lower contact areas are filled with the filler 9 before being joined (FIG. (9*c*)). In yet another construction, an upper part of the join of one of the plates 2 is superposed on a lower part of the join of the other plate, and a groove 15 is formed along the join line in the horizontal plane of the join 2*a* of one of the plates 2. A projection 16 engaging with the groove 15 is provided in the horizontal plane of the join 2*a* of the other plate 2, and metal edge reinforcers 17Å@ and 18 are coated on these joins 2*a*. The antirust, lubricating oil *i*4 is filled in the area where the groove and projection engage, and the filler 9 is filled in the upper and lower contact areas (FIG. 9(*d*)). Any of these types of join can be used as may be suitable.

EMBODIMENT 2

Figure 10:
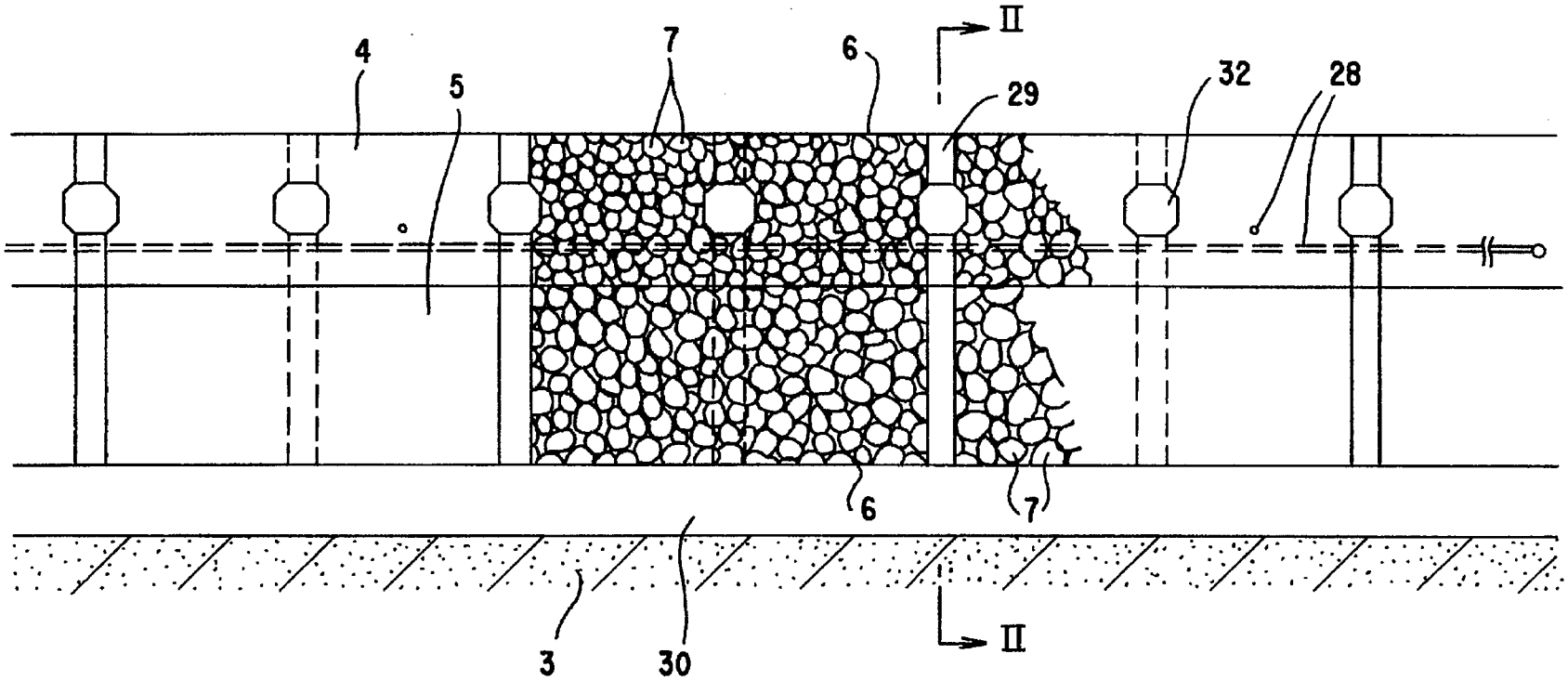
FIG. 10 is a sectional view perpendicular to a vehicle lane of a road surface according to the second embodiment of this invention.
Figure 11:
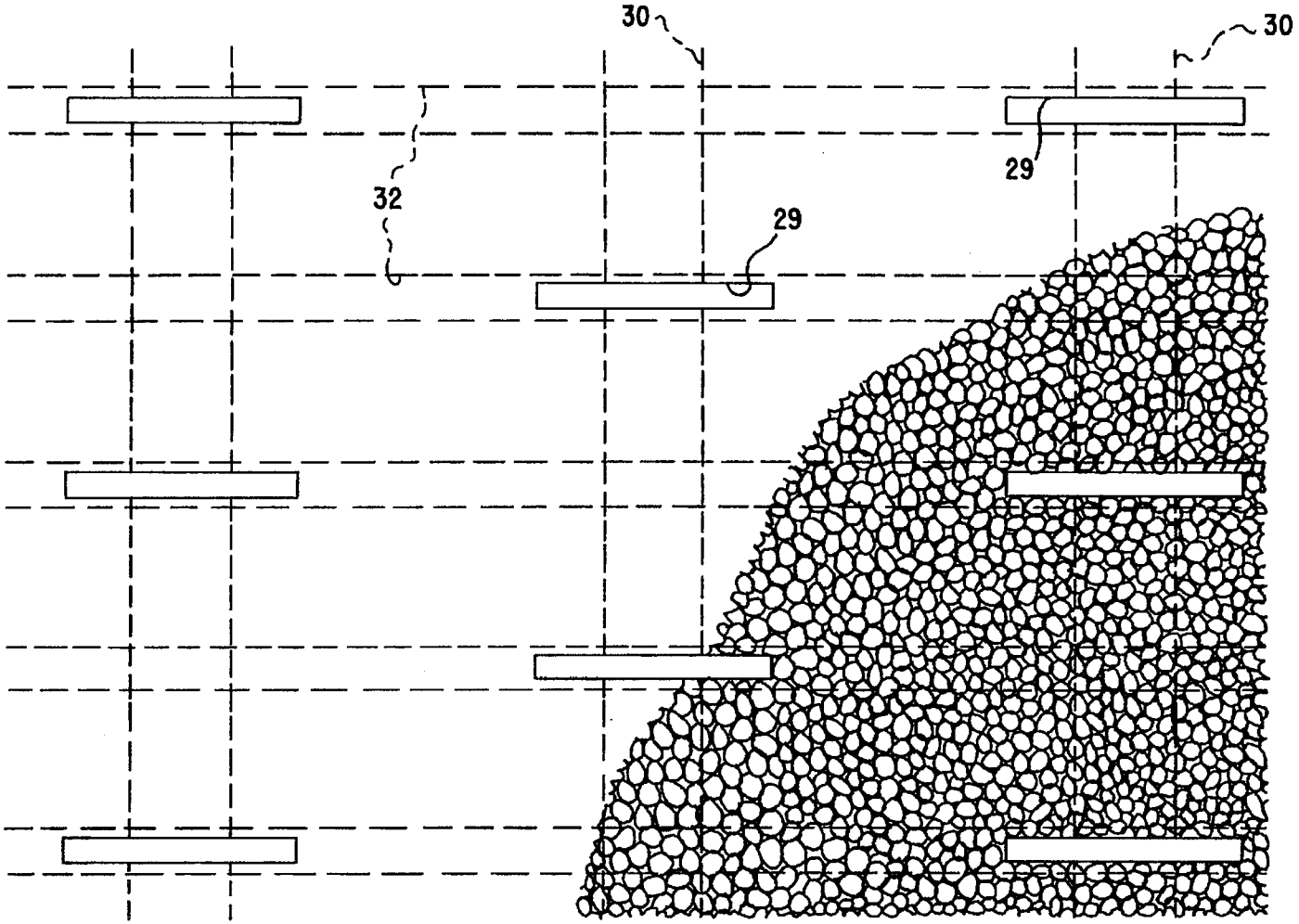
FIG. 11 is a plan view of the road surface shown in FIG. 10.
Figure 12:
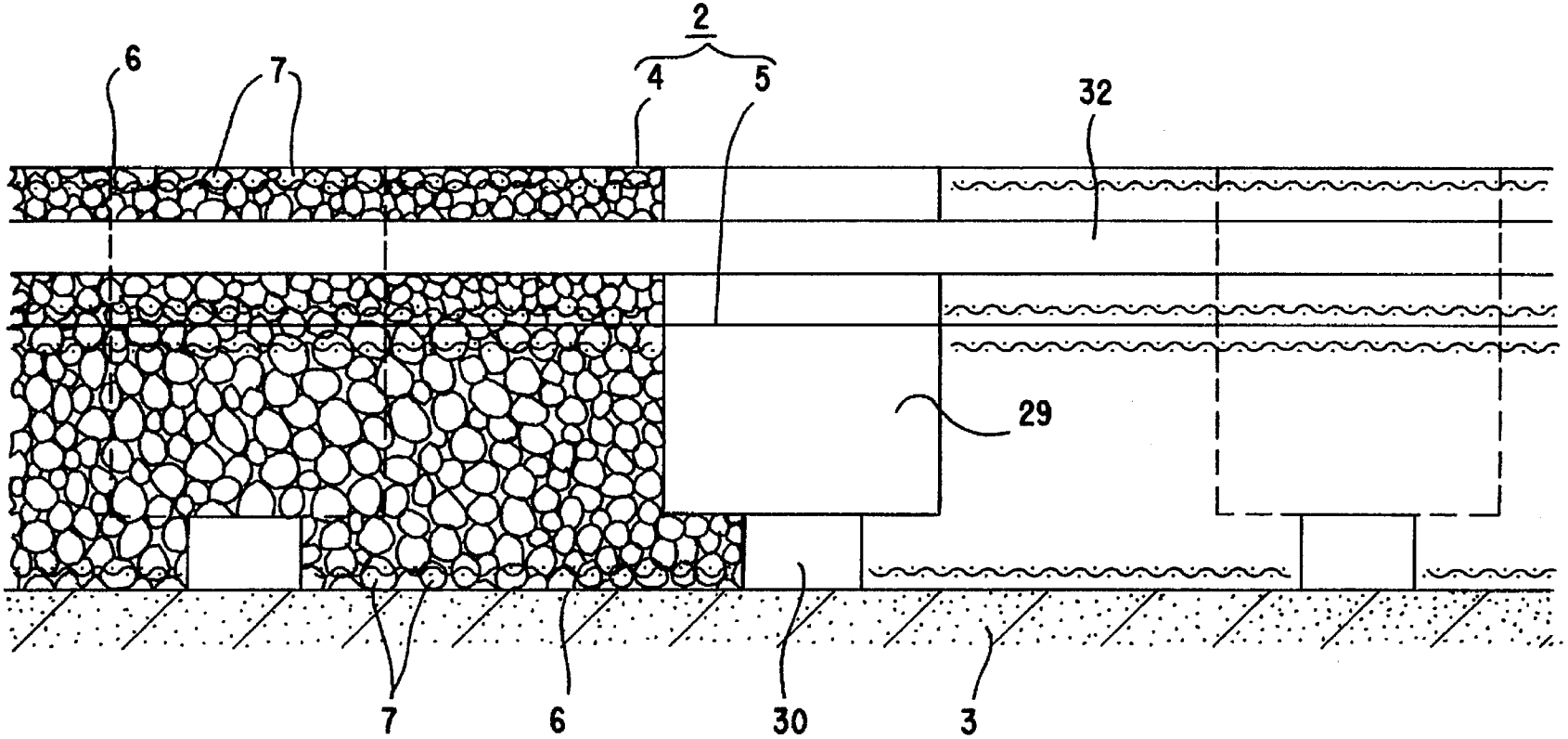
FIG. 12 is a sectional view In the vehicle lane direction of the road surface shown in FIG. 10.

FIG. 10 is a schematic sectional view showing a second embodiment of the road surface according to this invention. FIG. 11 is a schematic plan view of same. FIG. 12 is a sectional view taken along the line II—II in FIG. 10.

In this embodiment, a multiplicity of voids 32 are provided in the vehicle travel direction on the underside of the surface of the wearing course 4 instead of grooves. These spaces 32 flatten under wheel loads applied to the road surface so that depressions form, these depressions guiding the wheels in the same way as the grooves of Embodiment 1. This contributes to greater road safety.

The througholes 29 are provided in a vertical direction so as to connect with the voids 32, and the drain grooves 30 are situated at the lower ends of the througholes 29. Other parts of this embodiment are the same as those of the first embodiment. Identical parts are given the same symbols and their description is omitted.

OTHER EMBODIMENTS

In the aforesaid embodiments, the road surface 1 of this invention has been described as being formed on the concrete bed 3 supported by struts. However it may also be constructed in the same way on a roadbed 50 on a banking as shown in FIG. 13(*a*).

Figure 13A:
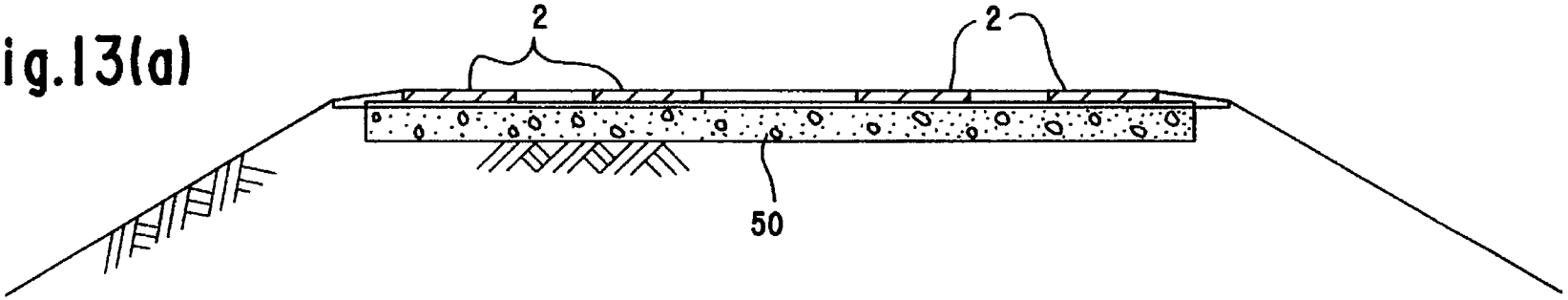
FIG. 13(*a*) is a schematic sectional view showing a third embodiment of the road surface according to this invention, wherein the road surface is constructed on a roadbed on a banking.
Figure 13B:
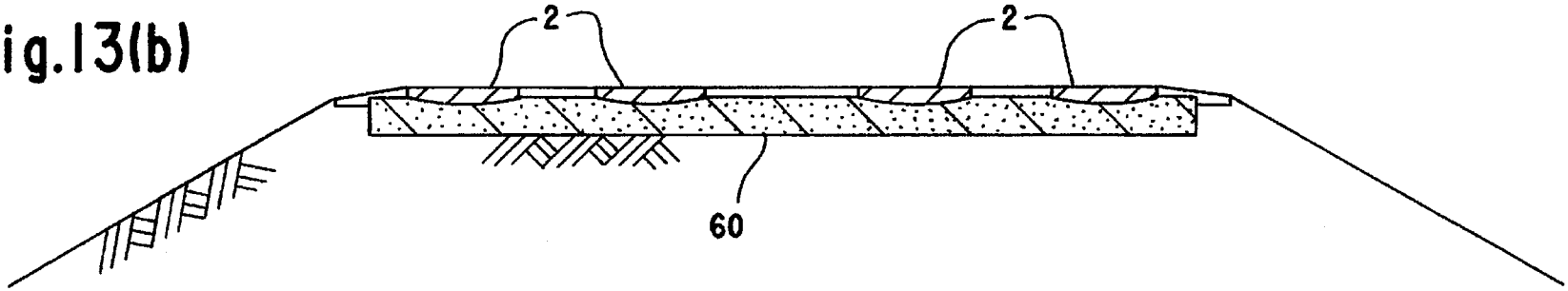

A concrete slab 60 may also be cast on the banking, and the road surface constructed on this slab as shown in FIG. 13(*b*).

Although the best mode contemplated for carrying out the present invention has been herein shown and described. It will be apparent to those skilled in the art that modification and variation may be made without departing from what is regarded to be the subject matter of the invention.

What is claimed is:

1. A road surface formed by laying on a roadbed a multiplicity of molded elastic plates each comprising aggregates having anti-wear properties mixed with rubber material wherein each of said elastic plates comprises a multiplicity of grooves in a vehicle travel direction formed on the top surface of said elastic plate, whereby said grooves help the vehicle to restore the vehicle travel direction thereof when a front wheel of the vehicle deviates from the vehicle travel direction, and suppress skidding and sideways slipping of the vehicle.

2. A road surface formed by laying on a roadbed a multiplicity of molded elastic plates each comprising aggregates having anti-wear properties mixed with rubber material wherein each of said elastic plates comprises a multiplicity of voids in a vehicle travel direction underneath the surface of said elastic plate, whereby said voids help the vehicle to restore the vehicle travel direction thereof when a front wheel of the vehicle deviates from the vehicle travel direction, and suppress skidding and sideways slipping of the vehicle.

3. A road surface formed by laying on a roadbed a multiplicity of molded elastic plates each comprising aggregates having anti-wear properties mixed with rubber material wherein each of said elastic plates comprises a multiplicity of through-holes in a vertical direction for allowing the passage of rainwater, and wherein each of said elastic plates comprise a multiplicity of drain grooves provided in an effectively perpendicular direction to a vehicle travel direction underneath each of said elastic plates, said groove being connected with said through-holes.

4. The road surface as defined in claim 1, wherein said grooves comprise a light reflecting layer or a light emitting layer on an inner wall of said grooves.

5. The road surface as defined in any one of claims 1, 2 and 3, wherein each of said elastic plates comprises a wearing course and a base course laid underneath said wearing course, an aggregate being mixed into said base course that is different from an aggregate mixed into said wearing course.

6. The road surface as defined in any one of claims 1, 2 and 3, further comprising fixing means each containing an anchor member and a press member that fixes said elastic plate to said roadbed.

7. The road surface as defined in any one of claims 1, 2 and 3, wherein said grooves comprise a light reflecting layer or a light emitting layer on a base surface of said grooves.

8. The road surface as defined in any one of claims 1, 2 and 3, wherein each of said plates comprises a heat emitting body embedded in each of said elastic plates.

9. The road surface as defined in any one of claims 1, 2 and 3, wherein each of said elastic plates comprises protrusions intermittently in said vehicle travel direction of said road surface so as to give a jolt to wheels of a vehicle traveling on said road surface in said vehicle travel direction.

10. The road surface as defined in any one of claims 1, 2 and 3, wherein each of said elastic plates are oriented adjacent another elastic plate at a joint which is at an oblique angle to said vehicle travel direction and each of said elastic plates are supported so as to permit relative displacement of each of said elastic plates relative to one another along a line defining a surface of said joint.

* * * * *